US006270134B1

(12) United States Patent
Lin

(10) Patent No.: US 6,270,134 B1
(45) Date of Patent: Aug. 7, 2001

(54) DUAL LAYERED HAND GRIP COVERINGS AND LINKS FOR HAND TOOL

(75) Inventor: Huey Yea Lin, Tay Pyng (TW)

(73) Assignee: Huey-Yea Lin (TW)

( * ) Notice: Subject to any disclaimer, the term of this patent is extended or adjusted under 35 U.S.C. 154(b) by 0 days.

(21) Appl. No.: 09/645,015

(22) Filed: Aug. 23, 2000

(51) Int. Cl.[7] ..... B25B 7/00

(52) U.S. Cl. ..... 294/16; 16/422; 16/431; 16/DIG. 12; 30/340; 81/177.1

(58) Field of Search ..... 294/16, 7; 30/262, 30/340, 341; 81/177.1, 319, 320, 489; 16/422, 430, 431, DIG. 12, DIG. 19

(56) References Cited

U.S. PATENT DOCUMENTS

| | | | | |
|---|---|---|---|---|
| 486,560 | * | 11/1892 | Dinkel | 30/262 |
| 1,503,536 | * | 8/1924 | Klauke | 30/341 |
| 2,520,808 | * | 8/1950 | Miller | 16/431 |
| 4,308,762 | * | 1/1982 | Jannard | 16/430 |
| 4,829,858 | * | 5/1989 | Kern et al. | 81/415 |
| 5,027,511 | * | 7/1991 | Miller | 16/430 |
| 5,253,557 | * | 10/1993 | Dolak | 30/340 |
| 5,591,176 | * | 1/1997 | Henderson et al. | 81/319 |
| 5,809,853 | * | 9/1998 | Hudson | 16/DIG. 12 |
| 6,044,734 | * | 4/2000 | Sellers et al. | 81/489 |
| 6,134,994 | * | 10/2000 | Gomas | 16/430 |

FOREIGN PATENT DOCUMENTS

| | | | | |
|---|---|---|---|---|
| 2935806 | * | 4/1981 | (DE) | 81/177.1 |

* cited by examiner

*Primary Examiner*—Dean J. Kramer
*Assistant Examiner*—Paul T. Chin
(74) *Attorney, Agent, or Firm*—Thomas M. Freiburger

(57) ABSTRACT

Dual layered hand grip coverings made of synthetic rubber by ejection molding and a link universally applicable to all hand tools are disclosed. The inner coverings are made of a hard material, while the outer coverings are made of a soft materials. The inner coverings are clad in the outer coverings directly at the time ejection molding process is carried out. A link is provided for the hand tool with its one end hinged to the inner covering of one hand grip, and the other end hinged to the inner covering of the opposite hand grip so that the hand tool may be conveniently put aside when not in use. Moreover, the two coverings are formed of differently colored materials so that purposely exposed portions of the inner coverings exhibit a strong color contrast with the outer coverings and a distinct identification marking.

5 Claims, 4 Drawing Sheets

DUAL LAYERED HAND GRIP COVERINGS AND LINKS FOR HAND TOOL

BACKGROUND OF THE INVENTION

1. Field of the Invention

The present invention relates to dual layered hand grip coverings and a link for hand tool, and more particularly, to dual layered hand grip coverings made of synthetic rubber by ejection molding and a link universally applicable to all hand tools.

2. Description of the Prior Art

A popularly used hand tool, for example, a pliers, is made of metallic material having a pair of symmetrical tool shanks hinged together at an appropriate position thereby forming a pair of tool sections at upper half parts and a pair of hand grips at lower half parts, and is able to clip or clamp an object between the two tool section by applying a compressive force between two hand grips with respect to the hinged point as a fulcrum by an operator's hand.

However, a hand tool constructed as such is apt to cause an accident when it slips unexpectedly out of the operator's palm, in addition, a hand tool made of hard metallic material brings uncomfortable feeling to the operator's hand. In order to eliminate above mentioned shortcomings, hand grips of a conventional hand tool are enclosed with a layer of either hard or soft covering made of plastic or rubber materials. However, in the case that such a covering is made of a hard material, the feeling of the operator's hand is uncomfortable in spite of the fact that hard covering is able to fit tightly as a globe to the hand grip. On the contrary, in the case that covering is made of a soft material, the operator's feeling may be better at the price of sudden slipping away of the covering as it can not fit tightly and securely to the metal hand grip.

SUMMARY OF THE INVENTION

Aiming at the above depicted defects, the present invention is to propose a newly developed construction for coverings for the grips of a hand tool.

Accordingly, it is a first object of the present invention to provide a link for the hand tool with which to shackle two shanks of the hand tool together so that the hand tool can be conveniently put aside when it is not in use.

It is a second object of the present invention to provide dual layered hand grip covering which can be used securely and comfortably with double colored, distinct identification marking yet preferable visual feeling.

The above mentioned objects can be achieved by a hand tool provide with a link and dual layered synthetic rubber hand grip coverings of the present invention comprising a tool body composed of two symmetrical tool shanks hinged together each further divided into two parts, e.g., a tool section above the hinge, and a hand grip below the hinge; two layers of ejection molded synthetic rubber coverings for each hand grip, the inner one is made of a hard material, while the outer one is made of a soft material, the inner covering is clad in the outer covering directly at the time ejection mold process is carried out; and a link with its one end hinged to the inner covering of one hand grip, and its other end hinged to the inner covering of the opposite hand grip. The two coverings are formed of differently colored materials so that purposely exposed portions of the inner layer exhibit a strong color contrast with the outer layer.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
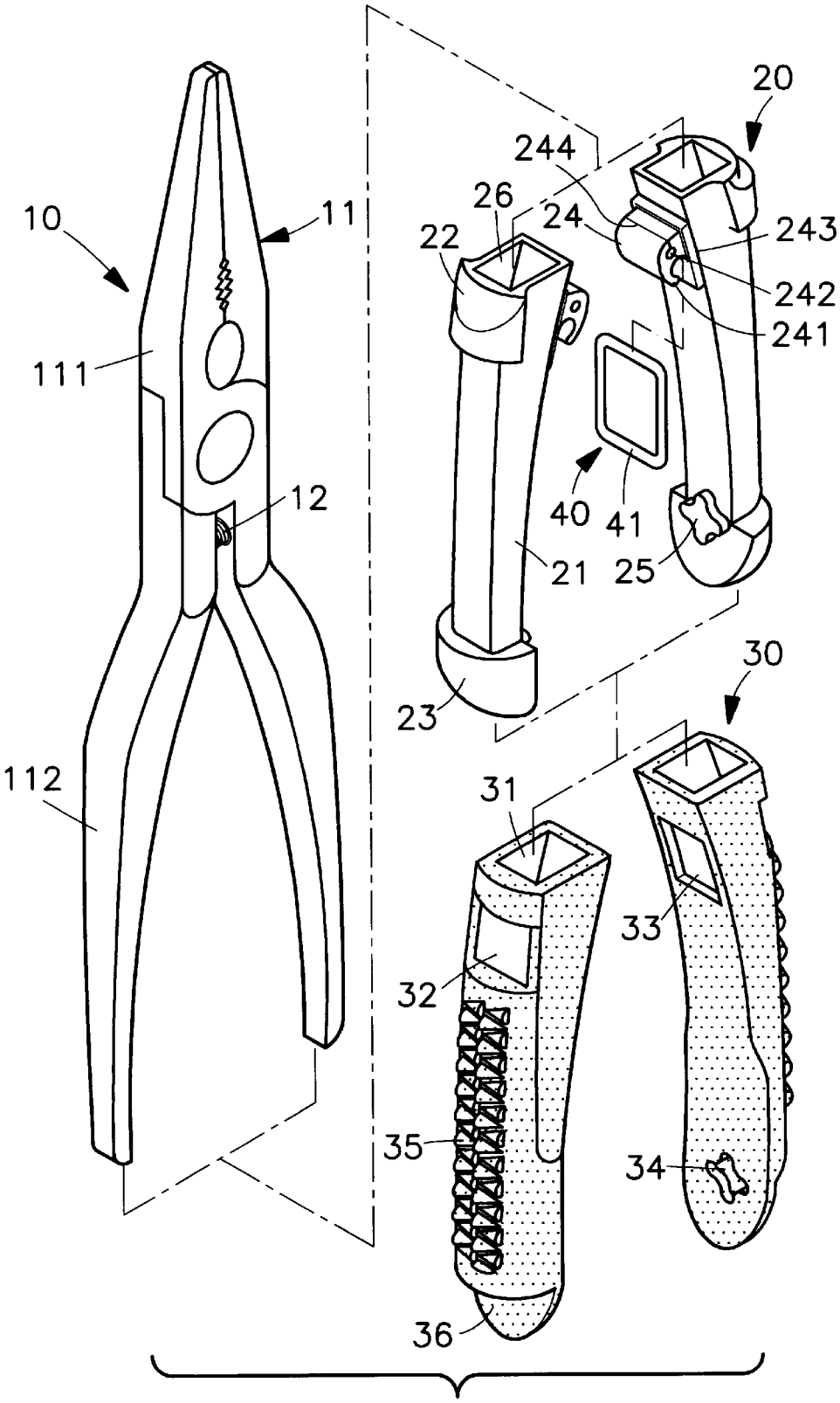
FIG. 1 is a three dimensional exploded view of the present invention.
Figure 2:
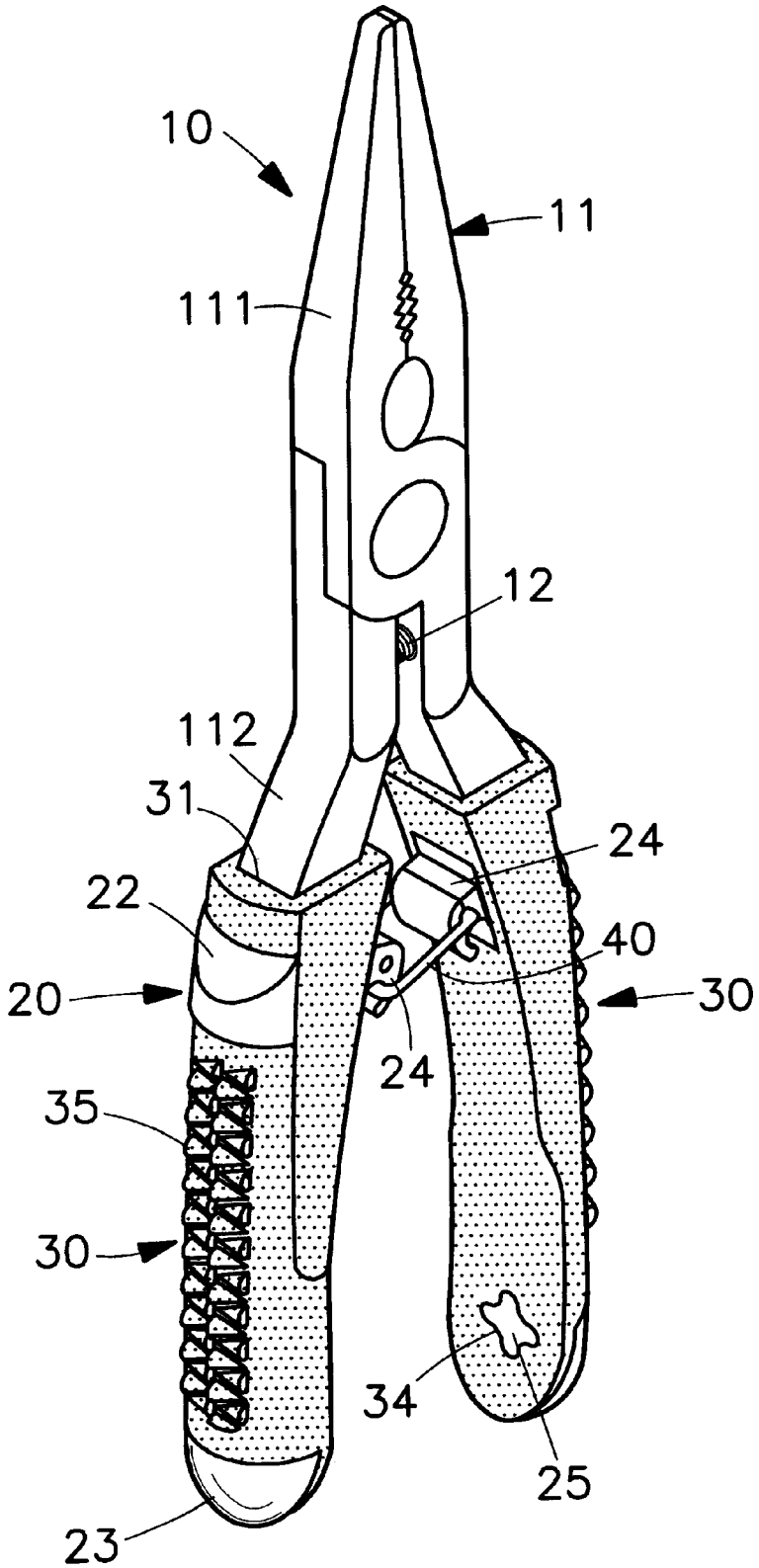
FIG. 2 is a three dimensional assembly view of the present invention.
Figure 3:
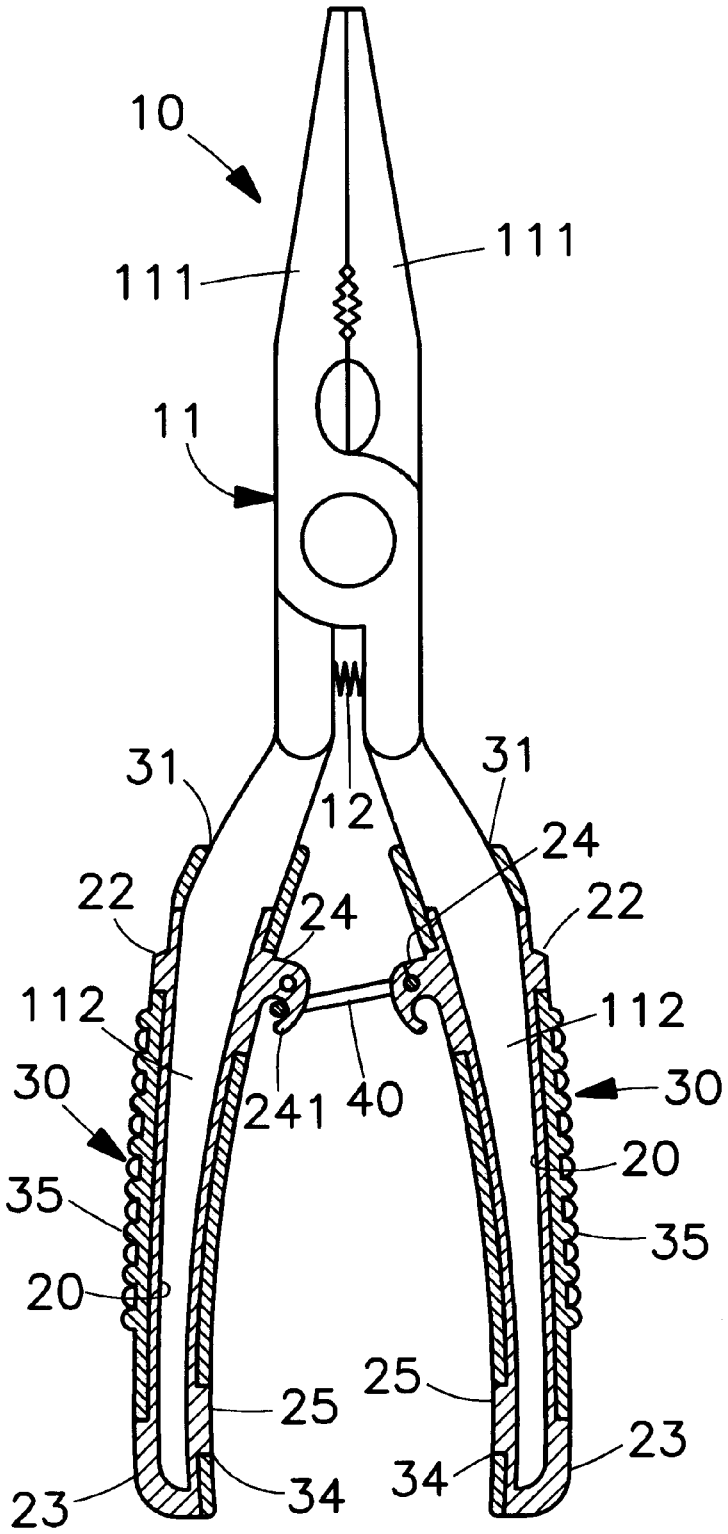
FIG. 3 is an illustrative assembly view of the present invention.
Figure 4:
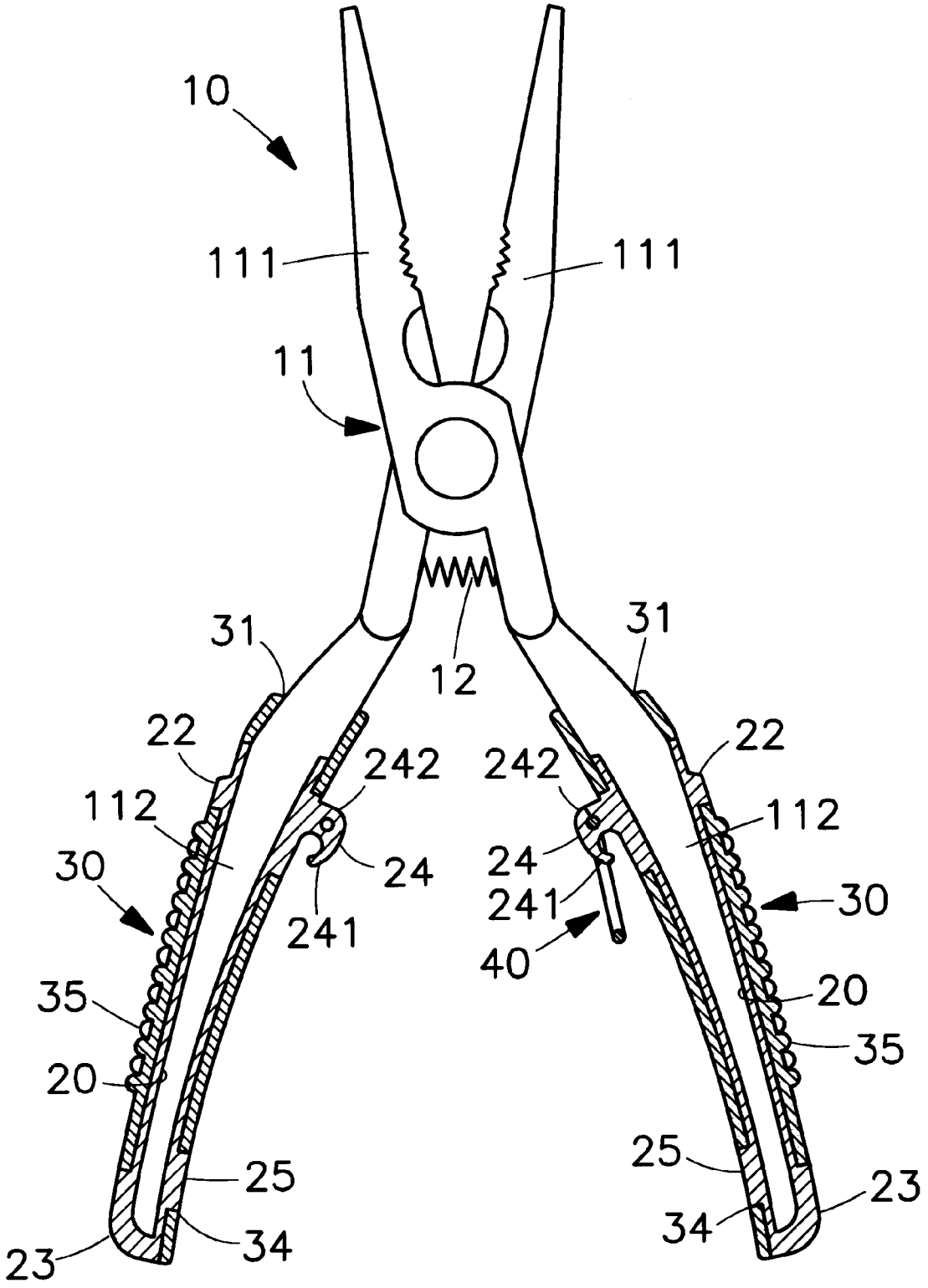
FIG. 4 is an illustrative view showing that the tool section is in an open state.

Referring to FIGS. 1 through 3 simultaneously, the hand tool in connection with the present invention comprises a tool main body 10, two inner coverings 20, two outer coverings 30, and a link 40.

The main body 10 consists of two metallic tool shanks 11 symmetrically hinged together each further divided into two parts, e. g., a tool section 111 above the hinge, and a hand grip 112 below the hinge, and a spring 12 is interposed between the two shanks 11 beneath the hinge.

Both inner coverings 20 are hard plastic formed in one piece by ejection molding. Each inner covering 20 has a body 21 with a protruded first stop block 22 and a protruded second stop block 23 respectively at its top end and bottom end, a protruded hook block 24 is formed at the upper inner side wall of the inner covering 20, a slot figured hasp 241 and an hinge eye section 242 thereabove are provided with the hook block 24. Besides, a clogging block 25 is formed on the lower part of the inner covering 20 at the same side with the hook block 24. An inner covering cavity 26 is formed along with the body 21 simultaneously the inner covering 20 is ejection molded, the cavity 26 has an open end for putting on the hand grip 112 of the tool shank 11.

The two outer coverings 30 are soft plastic formed in one piece by ejection molding. Each outer covering 30 has an outer covering cavity 31 with a figure matching the body 21 of the inner covering 20. Before proceeding ejection process, the inner covering 20 is set in advance in a die cavity so as to be clad in the outer covering 30 directly around the inner covering 20 in one piece with the ejection molding process. In addition, a first through hole 32, a second through hole 33, and a third through hole 34 all of them communicate with the outer covering through cavity 31. The first through hole 32 is for a first stop block 22 of the inner covering 20 to stretch out therefrom and clog thereat, the second through hole 33 is for the hook block 24 of the inner covering 20 to protrude out therefrom and the shape and size of the second through hole 33 have been made to match a base 243 of the hook block 24 so that the second through hole 33 and the base 243 may closely fit together. The bottom opening 36 of the outer covering through cavity 31 is clogged by the second stop block 23 of the inner covering 20. Besides, the clogging block 25 is clogged at the third through hole 34 located facing to it. A plurality of slip resistant protuberances 35 are formed on the outer side surface of the outer covering 30. Since the inner and outer coverings 20 and 30 are formed in one piece by ejection molding, and those first stop block 22, base 243 of the hook block 24, the second stop block 23, and the clogging block 25 of the inner covering 20 are engaged respectively to those first and second through holes 32, 33, bottom opening 36, and third through hole 34 of the outer covering 30 as described above. The two coverings 20 and 30 can be tightly fit each other. Besides, if the two coverings are formed with different colors, parts of the inner coverings 20 intermittently exposed out of those first to third through holes 32, 33, 34 and bottom opening 36 of the outer covering 30 can exhibit strong color contrast to the outer covering 30 and provide distinct identification marking and preferable visual feeling.

One end of the link 40 can be pushed into a hinge eye section 242 and turnably hinged thereof via a vertically chiseled slot 244 on the hook block 24 of the inner covering 20, but the installation form of the link 40 is not limited only such, other well known way of installation may be selected. The other end 41 of the link 40 can be optionally shackled the other hasp 241 provided on opposite inner covering 20.

After having finished reading over the above description of the present invention, one may clearly understand that the present invention has several features which are distinctly superior to any conventional techniques, and are as follows:

1) Dual layered hand grip coverings can achieve reliable and tight attachment to the hand grips of a tool shank without the fear of accidental slipping away from the operator's hand thereby ensuring perfect work security and providing the operator with a better hand feeling through the soft outer coverings.

2) Provision of a link helps put aside the tool when it is not in use.

3) Ejection molding in one piece of two coverings simplifies production process with increased production efficiency and reduced cost.

4) Double colored appearance exhibit strong color contrast, and provide distinct identification marking and preferable visual feeling.

Those who are skilled in the art will readily perceive how to modify the invention. Therefore, the appended claims are to be construed to cover all equivalent structures which fall within the true scope and spirit of the invention.

What is claimed is:

1. Dual layered hand grip coverings and a link for a hand tool comprising;

two inner coverings each having an inner covering cavity, made of a hard synthetic rubber material for clothing the hand grip of said tool, said inner covering has a protruded hook block on its inner surface with a hasp thereon and an hinge eye section;

two outer coverings made of a soft synthetic rubber material for clothing said inner coverings, a third through hole is provided at the position corresponding to said hook block of each said inner covering for said hook block to stretch out therefrom; and a link being able to push into said hinge eye section with its one end, while the other end being able to shackle another hasp provided on opposite inner covering.

2. The dual layered hand grip coverings of claim 1, wherein said inner covering includes a body having a protruded first stop block and a protruded second stop block respectively at its top and bottom end, said outer covering has a through cavity for putting therein the body of said inner covering, said outer covering further has a first through hole which corresponding to the position of said first block of said inner covering for said first block to expose and clog thereof, whereas said second stop block exposes out of a bottom opening of said through cavity and engages to said outer covering thereof.

3. The dual layered hand grip coverings of claim 2, wherein said inner covering has a clogging block formed on its lower part thereof which stretches out of a second through hole formed on said outer covering at the position corresponding to said clogging block such that said clogging block is clogged thereat.

4. The dual layered hand grip coverings of claim 2, wherein said outer coverings and said inner coverings are made of differently colored materials.

5. The dual layered hand grip coverings of claim 1, wherein a plurality of slip resistant protuberances are formed on the outer side surface of said outer covering.

* * * * *